US005458274A

United States Patent [19]

Maietta

[11] Patent Number: 5,458,274

[45] Date of Patent: Oct. 17, 1995

[54] CONTAINER-CLOSURE ASSEMBLIES WITH COOPERATING RING AND GROOVE AUDIBLE SIGNALING STRUCTURE

[76] Inventor: Michael G. Maietta, Box 19, R.D. 3, Cogan Station, Pa. 17728

[21] Appl. No.: 196,697

[22] Filed: Feb. 15, 1994

Related U.S. Application Data

[63] Continuation of Ser. No. 785,440, Oct. 29, 1991, abandoned.

[51] Int. Cl.[6] ..... B67D 5/32

[52] U.S. Cl. ..... 222/39; 222/92; 222/491

[58] Field of Search ..... 222/39, 92, 107, 222/491, 494; 215/201, 343, 344; 220/203, 209

[56] References Cited

U.S. PATENT DOCUMENTS

| | | | |
|---|---|---|---|
| 1,865,764 | 7/1932 | Keenan | 220/203 X |
| 1,905,936 | 4/1933 | Heard | 222/494 |
| 3,081,006 | 3/1963 | Land | 222/212 |
| 4,598,839 | 7/1986 | Dombroski et al. | 222/92 |
| 4,776,495 | 10/1988 | Vignot | 222/491 X |
| 5,004,127 | 4/1991 | Morel | 222/521 |
| 5,016,787 | 5/1991 | Beck | 222/519 X |
| 5,042,690 | 8/1991 | O'Meara | 222/83 |
| 5,199,605 | 4/1993 | Schneider | 222/25 |

FOREIGN PATENT DOCUMENTS

| | | | |
|---|---|---|---|
| 2234965 | 2/1991 | United Kingdom | 222/494 |

*Primary Examiner*—Andres Kashnikow
*Assistant Examiner*—Joseph A. Kaufman
*Attorney, Agent, or Firm*—Eugene E. Renz, Jr.

[57] ABSTRACT

A cap and tube device comprising a tube having an opening terminating in a nozzle with an open end and having threads for rotational engagement with a cap. Also included is a check valve in the interior of the nozzle for permitting flow of tube contents substantially only out of the tube while preventing return flow of contents into the tube. The cap is sized to engaged the nozzle at its open end and has a closed terminal end having a first inwardly facing axially centered locating cup for engagement with the open end of the nozzle, and a second inwardly facing axially centered sealing cup for engagement with the open end of the nozzle to form a seal in the nozzle open end. Finally, the cap and tube have a cooperative ring and groove for locating the cap on the nozzle at the position where the sealing cup is in engagement with the nozzle and the ring and groove provide a signal upon full engagement of the cap and tube.

9 Claims, 2 Drawing Sheets

CONTAINER-CLOSURE ASSEMBLIES WITH COOPERATING RING AND GROOVE AUDIBLE SIGNALING STRUCTURE

This is a continuation of application Ser. No. 07/785,440 filed on Oct. 29, 1991 now abandoned.

FIELD OF THE INVENTION

The present invention relates to tamper evident closures and more particularly to containers with cap closures which have been adapted for dispensing toothpaste, ointments, and other paste and flowable solid formulations.

BACKGROUND OF THE INVENTION

Tamper evident closures are not new per se. In almost in any product which is intended to be consumed or otherwise be in contact with humans, either internally or externally, there is a desire to package the product so that there is visual evidence of the product having been opened. This will alert the user to the possibility of tampering and or opportunities for spoilage.

Plastic shrink wrapping of the closure on the cap has not met with any significant success in the consumer market because of the difficulty in removing the seal as well as the need for removing bits and pieces of shrink wrap plastic on the container. More often than not, the consumer feels that this is an unattractive way of displaying goods and the consumer selects another product using other packaging.

One particular class of goods which is particularly susceptible to tampering and/or spoiling when a seal is not complete is the class of containers in which a cap is attached to a nozzle by threads. The age-old battle between those who replace the toothpaste cap and those who do not is not only a humorous distinction between individual preferences. Increased concern for safety and for sanitation has caused serious attention to be given to effectively closed caps.

One method for maintaining tamper evident features is disclosed in U.S. Pat. No. 4,848,615. In this patent, a fracture tear band is provided which can be removed once and which then identifies that the contents have been exposed. This method, however, does away with a screw cap closure design and relies upon a cap which can be pried upwardly. While this design is highly effective in providing the tamper evident feature, it does not maintain the appearance of the container. In addition, there is no separate functional component or components which serve to protect the integrity of the seal, particularly when the container is to be used over a significant period of time.

Toothpaste tubes and other similar products have a cap which is removed once or more every day over a relatively long period of time. It is desirable that the freshness of the contents be maintained and that a seal be effective every time the cap is replaced on the tube. Some ordinary cap and tube assemblies facilitate the frequent removal and return of the cap on the tube but these designs do not provide any clear evidence that a seal has been effective once the cap has been replaced.

In addition, sanitary practices indicate that material which has been withdrawn from a tube has a much greater chance of contaminating the remaining contents. No prior art design addresses this problem.

Accordingly, it is an object of the present invention to provide a new improved container assembly for cap and tube devices. It is another object of the present invention to provide a cap and tube device which explicitly identifies the arrival of the cap at a sealed condition.

Other objects will appear hereinafter.

SUMMARY OF THE INVENTION

It has now been discovered that the above and other objects of the present invention may be accomplished in the following manner. Specifically, a new and improved cap and tube device has been discovered.

The tube and cap device of the present invention includes a tube having an opening terminating in a nozzle with an open end. The nozzle has means for rotational engagement with a cap, such as threads.

A check valve is mounted in the interior of the nozzle for permitting flow of the tube contents substantially only out of the tube and preventing return of contents into the tube. Thus, when the tube is squeezed, content will exit through the check valve but will not be permitted to return into the tube because of the check valve.

A cap is provided which is sized to engaged the nozzle at the open end via the rotational engagement means. The cap has a closed terminal end which has a first inwardly facing center locating cup for engagement with the open end of the nozzle and a second inwardly facing axially centered sealing cup for engagement with the open end of the nozzle to form a seal in the open end of the nozzle.

The cap and tube have a cooperative ring and groove means for locating the cap on the nozzle at a position where the sealing cup is in engagement with the nozzle end. The ring and groove means are further adapted to provide a sign, such as a click, upon engagement of the nozzle end with the sealing cup.

In a preferred embodiment, the check valve means includes a first annular disk having a hinged central portion for movement into and out of transverse alignment with the flow of contents from the tube through the nozzle. A second annular disk is provided having an open central portion which is smaller than the first annular disk central portion to provide a valve seat to thereby prevent movement of the first disk inward of the transverse alignment.

Also, in a preferred embodiment, the nozzle includes an interior annular groove for supporting and locating the second disk on the periphery of the disk. The first disk includes an annular outward ring for supporting the hinged central portion of the first disk. The annular outward ring of the first disk is positioned on the second disk by the interior annular groove on the nozzle. The annular outer groove of the first disk and the second disk are snap fit into the interior annular groove on the nozzle.

In another preferred embodiment, the nozzle is tapered from the cooperative ring and groove means to the open end of the nozzle. The first inwardly facing axially centered locating cup is also cooperatively tapered for interaction with the tapered nozzle to guide the open end to the sealing cup. In essence, the open tapered nozzle and the locating cup function together as a centering agent for guiding the open end to the sealing cup.

BRIEF DESCRIPTION OF THE DRAWINGS

These and other objects of the present invention and the various features and details of the operation and construction thereof are hereinafter more fully set forth with reference to the accompanying drawings, where.

DETAILED DESCRIPTION OF THE PREFERRED EMBODIMENT

Figure 2:
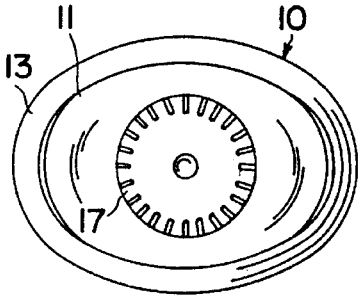
FIG. 2 is a plan view of the device shown in FIG. 1.

As shown in the drawings, the preferred embodiment is a cap and tube device designated generally at 10. The device includes a tube 11 which has a base 13 which functions as the filling end of the tube in a conventional manner. At the other end of tube 11, a tapered annular end 15 is provided for mounting a cap 17.

Figure 3:
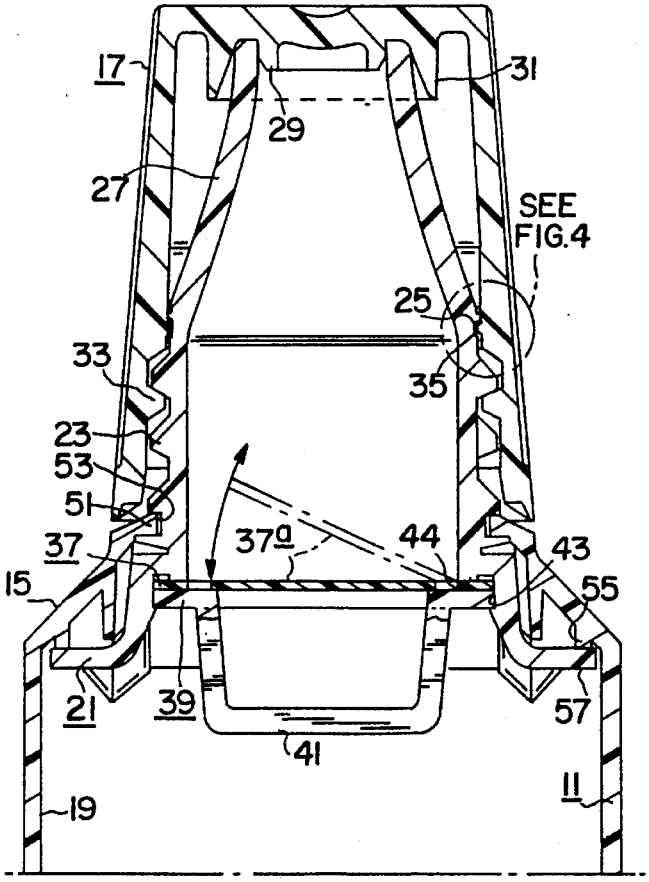
FIG. 3 is a sectional view taken along line 3—3 of FIG. 1.
Figure 1:
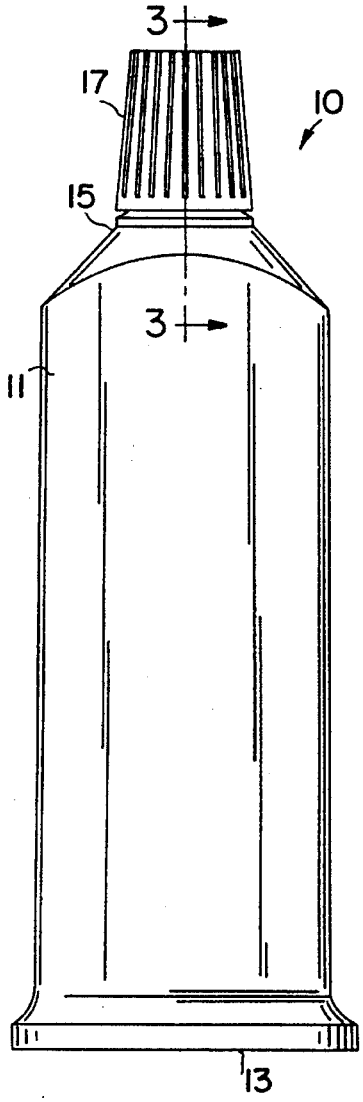
FIG. 1 is a front elevational view of a tamper evident closure in accordance with the present invention.

Turning to FIG. 3, the tube wall 19 is fitted on a nozzle base 21 which has nozzle threads 23 and which terminates in a tapered upper end 27. The tapered end 27 of nozzle 21 engages a plurality of sealing means at the closed terminal end of cap 17. Specifically, the nozzle is sealed by engagement of its end 27 with an annular sealing cup 29 and the base portion of locating cup 31, both of which are located on the interior closed end of cap 17. As can be seen, when the cap is repeatedly removed and replaced, the tapered locating cup 31 guides the tip 27 of nozzle 21 into a firm and effective seal with annular sealing cup 29.

Figure 4:
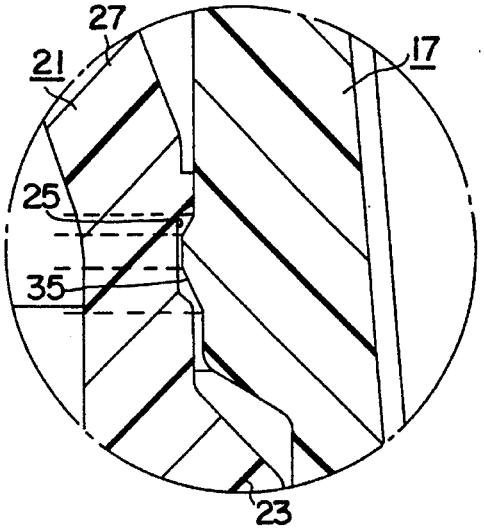
FIG. 4 is an enlarged sectional view of the portion of FIG. 3 enclosed in the dot and dash circle and designated FIG. 4.
Figure 5A:
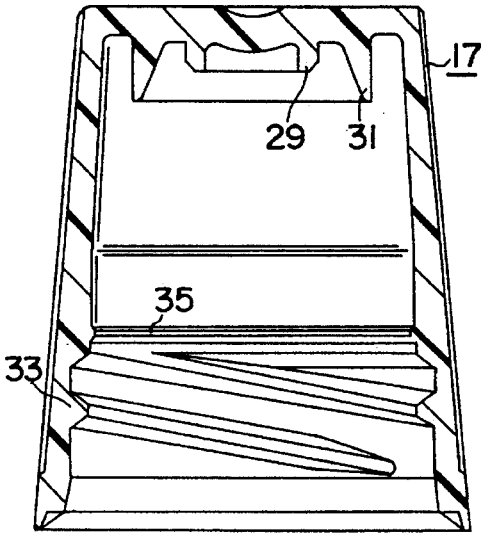
FIGS. 5A & 5B are combined sectional views of the embodiment shown in FIG. 3, shown exploded to illustrate the two components of the embodiment.

The user is notified that the end 27 of nozzle 21 has sealed effectively in the inner annular sealing cup 29 by the co-action of a groove 25 on nozzle 21 and a ring 35 on cap 17. Shown in FIG. 4 is an enlarged view identifying the relationship between the tapered nozzle 27 and the cap 17 as ring 35 enters groove 25. Ring 35 and groove 25 are configured to locate the cap 17 on the nozzle 27 at a position where the sealing cup 29 is in sealing engagement with nozzle end 27. The ring 35 and groove 25 can provide a signal upon such engagement, such as an audible click or by a tactile engagement where the "feel" of the seating of the engagement provides the signal. This "feel" will be observable as the cap threads 33 and nozzle threads 23 bring nozzle tip 27 into the sealed engagement with annular sealing cap 29.

Another important feature of the present invention is the inclusion of a check valve which permits flow of the contents of the tube out through the nozzle. The check valve may take many forms, but in its preferred embodiment includes a first annular disk 37 which is supported on a second annular disk 39, where second disk 39 has a smaller centrally located annular opening so that disk 37 is prevented from moving in the direction from the nozzle to the tube. The first annular disk 37 has a hinged central portion **37*a* which is moveable into and out of a transverse alignment with the flow of contents from the tube to the nozzle. In this manner, the second annular disk 39 functions as a valve seat to prevent movement of the central disk 37*a*** inward of that transverse alignment.

Figure 6:
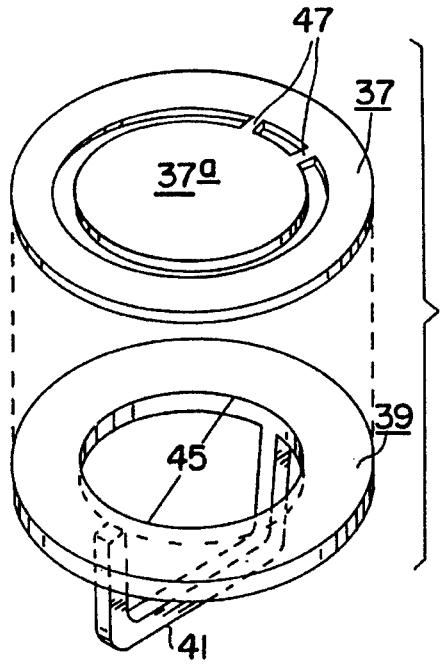
FIG. 6 is an exploded perspective view showing the two elements taken from FIG. 5B.
Figure 5B:
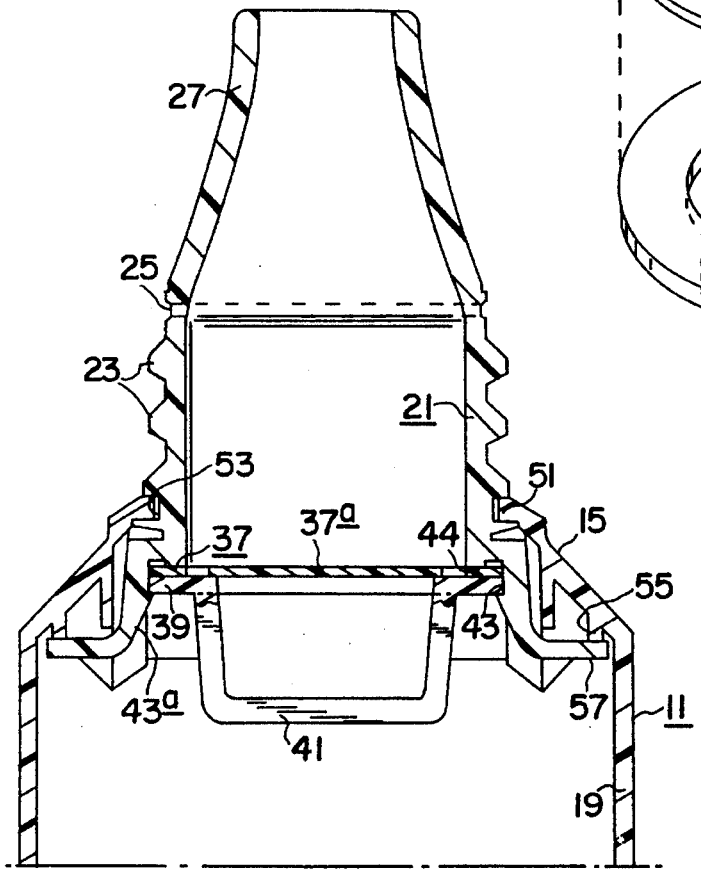

The second disk 39 includes a handle 41 for positioning the elements as they are assembled. Disk 39 fits into an interior annular groove 43 which is formed in nozzle 21. Disk 37 is then placed on top of disk 39 and fitted into the upper annular surface 44 of groove 43. As seen in FIG. 5B, groove 43 includes a tapered front portion **43*a* which facilitates assembly of the check valve in the nozzle apparatus. Specifically, disk 37 is placed on top of disk 39 and both are guided against the cone shaped surface 43*a*, using handle 41, until the first disk 37 engages angular surface 44 and then second disk 39 fully enters interior angular groove 43 to form a snap fit. The upper disk 37 and annular disk 39 are shown separate from the device in FIG. 6. The relationship of the smaller diameter 45 of second disk 39 to the size of the central portion 37*a* of the upper disk 37 can be easily seen. Alignment of disk 39 with hinge 47 allows central portion 37*a* to move and disk 39** functions as a check valve.

FIG. 5B also shows additional features of the assembly process by which the device of the present invention is manufactured. In addition to positioning the annular disks 37 and 39 in the interior angular groove 43 and against the annular surface 44, using handle 41 as previously described, the nozzle 21 can be assembled on to the tube 11 as follows.

Tube wall 19 includes an upper terminal end 51 which faces radially inwardly at the terminal end and toward tapered annular end 15 which, as will be appreciated, includes some degree of flexibility. Nozzle 21 includes an annular groove 53 below the threads 23 so that nozzle 21 can be threaded onto terminal end 51 and press fit into groove 53 to permit location of nozzle 21 on the tapered end 15 of tube 19. Tapered end 15 of tube 19 also includes at least one annular inwardly facing ring 55 which abuts against the flaired annular terminal end 57 of base 21 to provide outer stability and cooperate with the terminal end 51 in groove 53 and provide a double engagement of the nozzle base 21 in the tapered end 15 of tube wall 19.

Thus, during assembly of the device of the present invention, the annular disks 37 and 39 are first inserted into the base of nozzle 21, locating the disks 37 and 39 in the annular groove 43 and annular surface 44. Next, the entire nozzle is threaded onto the tapered annular end 15 of tube wall 19 via the upper terminal end 51 of the tapered wall 15 until the terminal end 51 engages groove 53. At this point, the annular ring 55 is supported by the flared annular terminal end 57, and the nozzle, check valve and tube have been assembled. It is then an easy matter to add cap 17 to complete the device shown in FIG. 3.

During operation, the device of the present invention permits a safe and effective seal of the end of the nozzle 27. Upon removal of the cap 17, contents can be squeezed or otherwise withdrawn from tube 11 in the discharge mode, while contents are prevented from reentering the tube 11 from nozzle 21 by the check valve formed by the inner annular disk 37 as it abuts against the second annular disk 39 having central hole 45. After use, the cap 17 is threaded on nozzle 21 until a signal is generated by the cooperative ring and groove assembly 35 and 25, indicating nozzle 27 has sealingly engaged sealing cup 29.

While particular embodiments of the present invention have been illustrated and described herein, it is not intended to limit the invention. Changes and modifications may be made therein without departing from the scope of the following claims:

What is claimed is:

1. A container, comprising: a hollow body terminating in a radially inwardly directed lip defining an opening at one end; a nozzle having a discharge end and an opposite end having an annular groove for engagement with said lip to position said nozzle on said hollow body; cooperating thread means on a cap and said nozzle for positioning said cap in a sealed position in the container; cooperative ring and groove means on said nozzle and cap above said thread means adapted to provide an audible signal upon seating of said cap on said nozzle in a sealed position; said nozzle having a radially outwardly directed flange and said hollow body having an annular interior shoulder, whereby said flange and said shoulder cooperatively support said nozzle on said hollow body without misalignment; and check valve means mounted in the interior of said nozzle for permitting flow of hollow body contents substantially only out of said hollow body while preventing return flow of said contents into said hollow body, said check valve means including a first annular disk having a hinged central portion for movement into and out of transverse alignment with said flow of contents from said hollow body, and a second annular disk having an open central portion smaller than said first annular disk for providing a valve seat to prevent movement of said first disk inward of said transverse alignment.

2. The combination, comprising:

a container having a nozzle with a discharge end;

a cap cooperatively engaging said container and having a seal for sealing engagement with said discharge end of said nozzle;

cooperating thread means on said cap and nozzle for positioning said cap in a sealed position on said container;

cooperative ring and groove means on said nozzle and cap above said thread means adapted to provide an audible signal upon sealing of said cap on said nozzle in a sealed position;

check valve means comprising a first annular disk having a hinged central portion for movement into and out of transverse alignment with the flow of contents from said container; and a second annular disk having an open central portion smaller than said first annular disk for providing a valve seat to prevent movement of said first disk inward of said transverse alignment.

3. The device of claim 2 wherein said nozzle includes an interior annular groove for supporting and locating said second disk on the periphery thereof.

4. The device of claim 3 wherein said first disk includes an annular outer ring for supporting said hinged central portion, said annular outer ring being positioned on said second disk by said interior annular groove on said nozzle.

5. The device of claim 4 wherein said annular outer ring and second disk snap fit in said interior annular groove.

6. The combination, comprising:

a container having a nozzle with a discharge end;

a cap cooperatively engaging said container and having a seal for sealing engagement with said discharge end of said nozzle;

cooperating thread means on said cap and nozzle for positioning said cap in a sealed position in said container;

cooperative ring and groove means on said nozzle and cap above said thread means adapted to provide an audible signal upon sealing of said cap on said nozzle in a sealed position;

said nozzle being tapered from said cooperative ring and groove means to the open end of said nozzle; and a first inwardly lacing locating ring on said cap cooperatively tapered for guiding the nozzle discharge end to engage said seal.

7. The combination, comprising: a container having a nozzle with a discharge end; a cap cooperatively engaging said container and having a seal for sealing engagement with said discharge end of said nozzle; cooperating thread means on said cap and nozzle for positioning said cap in a sealed position in said container; and cooperative ring and groove means on said nozzle and cap adapted to provide an audible signal upon seating of said cap on said nozzle in a sealed position.

8. The combination as claimed in claim 7, wherein the groove means comprises a circumferentially extending groove on the outer peripheral surface of the nozzle adjacent the thread means on the nozzle and the ring comprises a circumferentially extending rib on the interior of the cap adjacent the threads on the cap.

9. The combination as claimed in claim 7, wherein the thread means are located adjacent the lower end of the nozzle and cap and wherein the cooperating ring and groove means are located above the thread means on the cap and nozzle.

* * * * *